United States Patent [19]

Lemcke et al.

[11] 4,255,374

[45] Mar. 10, 1981

[54] METHOD OF COMPACTING POWDER

[75] Inventors: Bo Lemcke, Lausanne; Derek Raybould, Preverenges, both of Switzerland

[73] Assignee: Institut Cerac S.A., Ecublens, Switzerland

[21] Appl. No.: 918,143

[22] Filed: Jun. 22, 1978

[30] Foreign Application Priority Data

Jul. 4, 1977 [CH] Switzerland ..... 8204/77

[51] Int. Cl.[3] ..... B22F 3/14

[52] U.S. Cl. ..... 264/111; 264/113; 264/122; 264/40.5

[58] Field of Search ..... 264/111, 122, 121, 113

[56] References Cited

U.S. PATENT DOCUMENTS

| | | | |
|---|---|---|---|
| 3,586,067 | 6/1971 | Bye-Jorgensen | 264/121 |
| 3,599,281 | 8/1971 | Boyer | 264/111 |
| 3,939,241 | 2/1976 | Powell et al. | 264/111 |

*Primary Examiner*—Donald E. Czaja

*Assistant Examiner*—James R. Hall

*Attorney, Agent, or Firm*—Frishauf, Holtz, Goodman & Woodward

[57] ABSTRACT

A method of compacting powder comprising interweldable particles into a solid body by using a shock wave. The shock wave has such an amplitude that interwelding of the particles in the powder is obtained. The shock wave is generated by impact of either a body impacted against the powder or by a capsule containing the powder, which capsule is impacted against a support instead of the body. The velocity at which the body or the capsule is impacted is about 300 to 2000 m/sec. The duration of the compacting pressure following behind the shock wave is determined by the chosen length and the chosen impedance of said body or said capsule and said support. The shock wave is chosen such that it propagates through the powder with a rise time which is shorter than the time necessary for obtaining equalization of the overall temperature. The compacting pressure must be maintained so long that the welds on the surfaces of the powder particles solidify.

23 Claims, 4 Drawing Figures

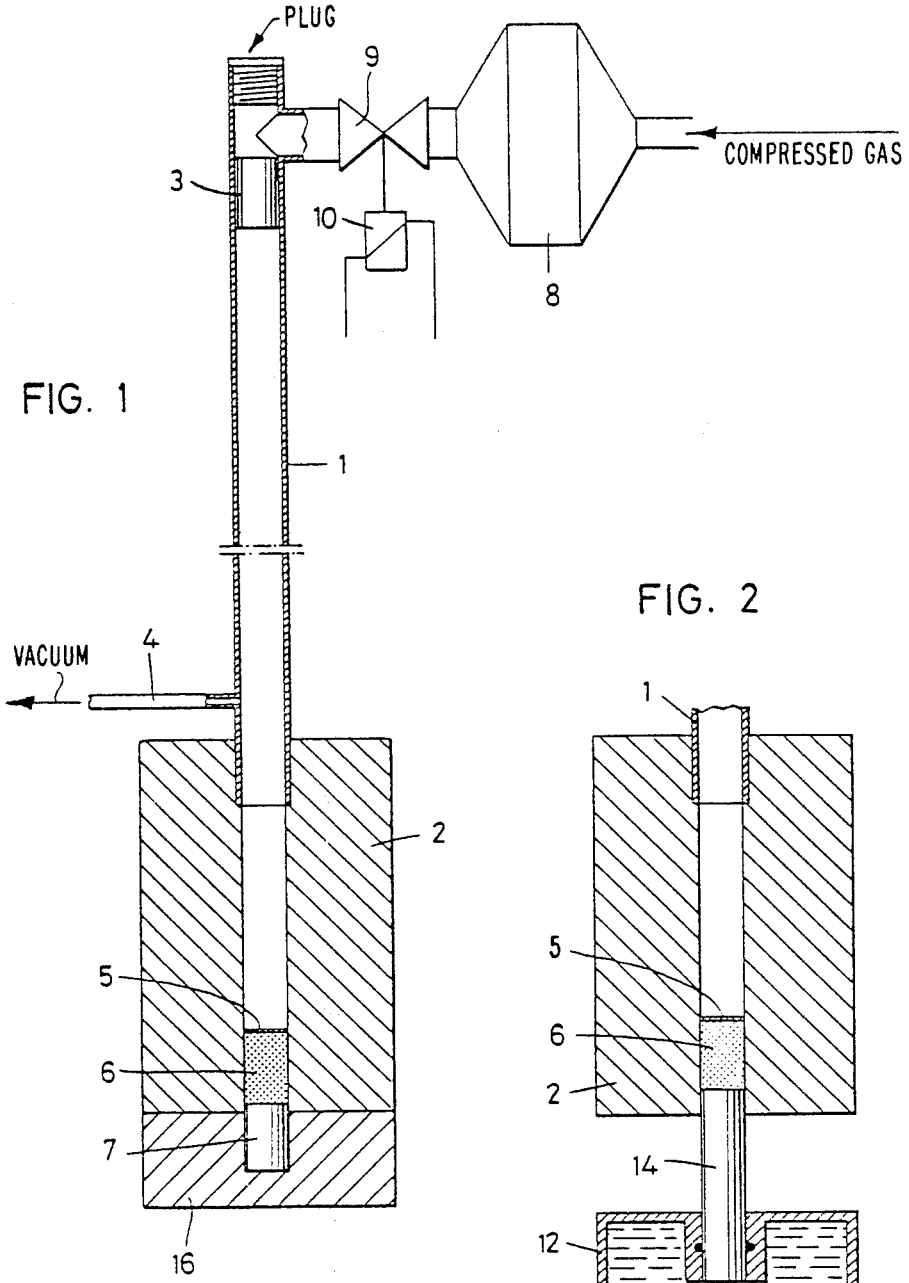
FIG. 1
FIG. 2
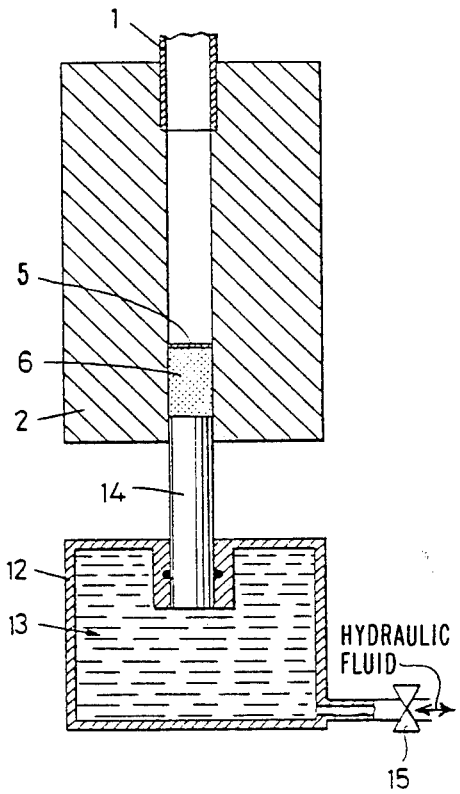

METHOD OF COMPACTING POWDER

BACKGROUND OF THE INVENTION

The invention relates to a method of compacting powder comprising interweldable particles into a unitary structure.

There are various methods of exerting pressure on powder in order to compact into a unitary structure or substantially solid body (hereinafter referred to simply as a "solid body"). The best known method of compacting powder consists in pressing the powder in a form die in a crank or hydraulic press. The compacted powder, a so-called green compact, is then sintered at a high temperature (e.g. for iron powder at a temperature of about 1150° C.) in a furnace with controlled temperature for about 30 minutes. After sintering, the brittleness of the compacted part largely disappears and the compact may have an acceptable strength, which approaches that of the basic metal. Such a method is, however, normally restricted to small parts. Furthermore, heavy-duty presses are required if high densities are to be reached.

Another known method of compacting metal or nonmetal powder is the explosive compaction method. Normally the powder is encapsulated in a can around which an explosive is placed. Some experiments have also been made in which a body was launched by explosion of the explosive to impact on the powder, whereby the speed of the body varied about 200 m/sec. By this technique it is possible to produce compacts having a density of 92 to 98% of that of the solid body. The main advantage of this technique is that without large capital expenditure rods of high density can be produced, which, according to need, may have large dimensions.

The mechanism of compaction by explosion is, however, not yet well-known. In any case, the method of compacting powder by using explosives is not easy, is not at all controllable and it is dangerous for the operator. This method allows practically only cylinders to be produced.

It is the object of the present invention to do away with the drawbacks of the known methods of compacting powder and to provide a method of compacting powder comprising interweldable particles whereby pure materials, alloys or layered structures can be obtained, the densities of which are close to the 100% limit, i.e. they approach the density of the basic metal or other material, without the necessity of a subsequent sintering process.

It is a further object of the present invention to provide a method of compacting powder, in which pure materials, alloys or layered structures are obtained having superior qualities than those of the pure materials, alloys or layered structures produced with the usual methods of compacting powder with subsequent sintering of the compacted parts. Furthermore, in the present invention, alloys or mixtures of materials should be produced, which otherwise cannot be produced with a known method in which high temperatures are used (i.e. sintering).

A still further object of the invention is to provide a method of compacting powder, in which parts of relatively large size and of various shapes (hence not only of cylindrical shape) can be produced.

SUMMARY OF THE INVENTION

According to the invention these objects are met with, in the introductorily mentioned method, in such a way that the duration of the compacting pressure following behind the shock wave is controlled by the choice of length and impedance of the mentioned body or the mentioned capsule and the mentioned support means, so that on one hand the shock wave is propagated through the powder with a smaller rise time than that necessary for obtaining equalization of the overall temperature in the powder and on the other hand the compacting pressure is maintained at least so long that the interparticle welds solidify.

Advantageously the compacting pressure exceeds the lower limit value defined by the following equation:

$$S \cdot d(1-a) \cdot (bP)^2 \cdot (1+bP)^{\frac{1}{2}} > a^{5/2} b^{5/2} \, Ts \, Cp \, K \rho^{3/2},$$

where s is the shape factor depending on the shape of the powder particles,
d is the size of the powder particles,
a is the initial functional density of the powder,
b is the compaction constant defined from the pressure, density relation,
P is the compaction pressure,
Ts is the melting temperature of the solid body,
Cp is the specific heat of the solid body
K is the thermal conductivity of the solid body,
$\rho$ is the density of the solid body

BRIEF DESCRIPTION OF THE DRAWINGS

FIG. 1 shows a schematic view partly in section of a device for compacting powder comprising a guide tube and a compaction chamber with a fixed support means for the powder.

FIG. 2 shows a section of a part of the device according to FIG. 1, but with a movable support means for the powder.

DETAILED DESCRIPTION

Figure 3:
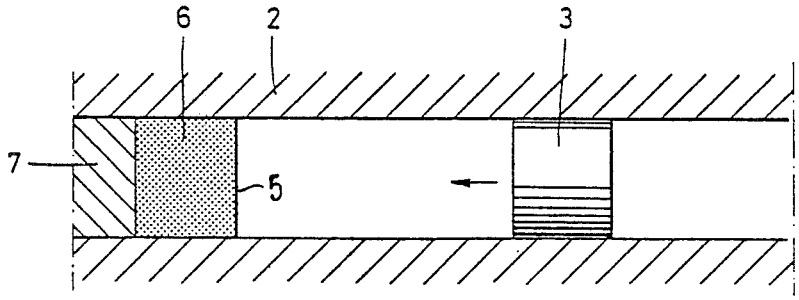
FIG. 3 shows a schematic view of the compaction chamber with a hammer body.

The factors determining whether a dynamically compacted part obtains a strength comparable to that of a solid body are complex. In their simplest form they can roughly be expressed such that the time during which compaction of powder occurs must be shorter than the time needed for equilization of the temperature distribution in the powder. The temperature distribution is created by the deformation of the powder particles during the compaction. This time is so short (in the order of microseconds) that the whole compacting pressure must be applied in one strong shock wave.

Even if good welds are produced, subsequent compaction may result in breakage of the created welds so that a compact with a strength similar to that of a quasi-static compact is obtained. Similarly, the passage of relief waves (waves reflected from a support means by which the powder is supported in a compaction chamber) may result in the welds being pulled apart before the liquid metal has solidified.

A detailed investigation of the factors affecting the strength has shown that the density of the solid body ($\rho$), the initial density (a), the size of the powder particles (d), the specific heat of the solid body (Cp), the thermal conductivity of the solid body (K), the melting temperature of the solid body (Ts), the compacting pressure (P) behind the compression wave and compaction constant (b) which is defined from the pressure density relation all are of importance. The importance of these parameters is obtained through calculation of the time during which compaction of the powder occurs and through calculation of the time necessary to equilibrate the temperature distribution in the powder. These times are equated and give a relation R which for welding to occur should be greater than 1.

$$R = s\frac{d(1-a)}{a^{5/2}b^{5/2}\,Ts\,Cp\,Kg^{3/2}}\cdot(bP)^2(1+bP)^{\frac{1}{2}} \quad (1)$$

The constant s in equation (1) is the shape factor which, as found experimentally, depends on the shape of the powder particles and to a lesser extent on the type of surface oxide film i.e., tenacious or brittle.

It has been found that s for a perfectly spherical powder such as lead shot is equal to 1. The value increases for irregular particles, e.g. sponge steel powder has the value of about 100 and atomized aluminum a value of 1000. In general it can be assumed that s for spherical powder is 1 and for powder with irregular shape s is about 100.

Such a variation of the value of s should be expected because equation (1) is based on the assumption that the powder particles are spherically shaped or that the heat zone just penetrates a relatively large, infinite and smooth surface. Both of these assumptions are valid for spherical lead shot. For irregular particles it is assumed that the peaks of the irregularly shaped particles are melted and hence the value of s increases. In reality s should probably be regarded as an indicator of the irregularity of a specific kind of powder.

It has been found experimentally that the kind of relations given by equation (1) are valid for different materials, but there are limits to its applicablity.

First, the relation according to Hall Petch prescribes that the strength of the compacts increases with decreasing size of the particles, as can be seen from the following equation (2).

$$\sigma=\sigma_o+Kd^{-m} \quad (2)$$

where $\sigma$ is the strength of the compact $\sigma_o$ is the strength of the annealed compact K is a constant d is the size of the particles m is a constant equal to $\frac{1}{2}$ in the true Hall Petch relationship, while equation (1) prescribes the opposite.

Both are valid relationships which must be compatible in practice. It was, for instance, found experimentally in the case of stainless steel that for a particle size, up to a certain value, the above mentioned equation (1) is the control equation, whereas for particles exceeding this size the Hall Petch relationship is usable, as is the case for conventional materials.

Second, compaction can be obtained through more than one compaction wave, in which case material cannot normally be produced having the same strength as that of the solid body. However, the above mentioned equation (2) may still be used for the last wave or that wave which produces the maximum work, provided this equation is suitably modified.

Third, it is possible that in many cases the time during which deformation occurs (the rise time of the shock wave) will not be controlled by the powder as assumed in the above mentioned equation, but rather is controlled by other factors such as air cushioning between the impactor and the powder or by the material (end plate) by means of which the powder is shielded off. In such cases the time during which deformation occurs and the time necessary for equilibrating the overall temperature should be calculated separately. The minimum pressure indicated in equation (1) may under certain circumstances be reduced by increasing the plastic deformation. This is possible if a die is used in which a substantial amount of plastic flow of the compacting powder is produced. In this case the above mentioned equation must be recalculated because the additional temperature rise resulting from the plastic deformation must be added to the temperature rise resulting from the compaction.

It should be noticed that the minimum pressure indicated by equation (1) represents a pressure below which interwelding of the particles does not occur. The corresponding minimum speed of the particles (and thus the speed of the shock wave) can be obtained from the shock relations. Obviously, there are several ways to obtain this minimum speed of the particles.

The device for carrying out the compacting method comprises a cylindrical guide tube 1, a compaction chamber 2 and means 7, 14 for supporting powder 6 arranged in the compaction chamber 2. A container 8 attached to the tube 1 contains compressed air, steam, helium or another compressible gas. For velocities not exceeding the value of 500 m/sec. compressed air at ambient temperature is sufficient. Steam and compressed air in a hot container are suitable for velocities up to 800 m/sec. Steam is best suited for a large number of repeated operations at large diameter. Still higher velocities can only be obtained with helium, combustion of fuel in compressed gas or by a two-stage gun with air. Over the whole range of velocities combustion of fuel is compressed air in combination with a one-stage gun is the best solution for such a device. The compressed gas is conducted into the container 8 by means of a not shown compressor. The compressed gas will be let into the tube 1 by means of a valve 9 controlled by an electric switch 10.

As alternative acceleration devices magnets, linear motors, multiple impact of solid bodies or impact by liquid can be used.

In the tube 1, which may be arranged horizontally or vertically, a hammer body 3 is movably inserted, which with its external wall sealingly fits the internal wall of the tube 1. At the opposite end of the tube 1 the powder 6 to be compacted is placed in the compaction chamber 2. A protective layer (plate) 5 protects the powder 6 against direct impact of the hammer body 3. A holding plate 16 for the fixed support means 7 is fixed to the compaction chamber 2.

The operation of the device is as follows.

First air must be withdrawn from inside the tube 1 via a conduit 4 which may be connected to a vacuum pump (not shown). The withdrawal of air can be excluded if the compaction chamber 2 of the tube 1 is provided with holes so that no air is trapped between the hammer body 3 and the powder 6. Then the valve 9 is opened in order to give the hammer body 3 the corresponding speed, with which it impacts on the powder 6, by means of the compressed air. The speed of the hammer body 3 can be adjusted and may be between 300 to 2000 m/sec. depending on the drive system. The hammer body 3 may be made of steel, aluminium or plastic or one may use a capsule 11 (FIG. 2) containing the powder, which, instead of the hammer body 3, is impacted against the support means 7 or 14. The length of the cylindrical guide tube 1 is about 10 to 100 times larger than the diameter of the hammer body 3.

The powder 6 is placed in the compaction chamber 2 in a cold state. It is, however, also possible to compact a pre-heated powder; this will reduce the amount of work needed to compact the powder 6 and further, a smaller temperature rise will be needed to melt the surface of the powder particles will decrease. The powder itself may be a metal powder, e.g. aluminium, iron, copper or steel or a non-metal powder, e.g. graphite.

Figure 4:
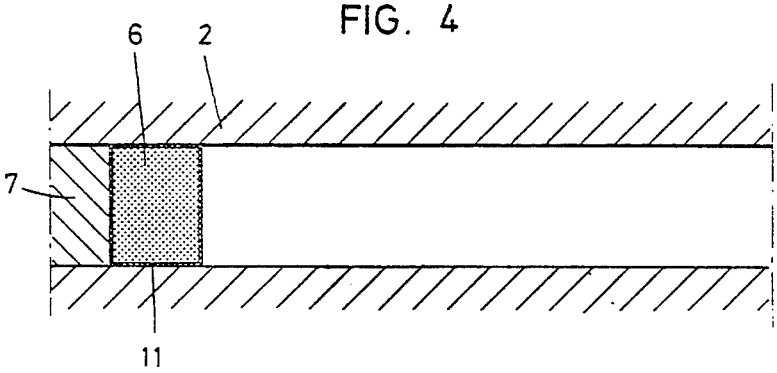
FIG. 4 shows a schematic view of the compaction chamber with a powder-containing capsule instead of the hammer body.

The support means can be a stationary support means 7 (FIGS. 1 and 3) or it can have the form of a rod 14 (FIG. 2) which is movable in the impact direction, whereby the length of the rod is such that the compacted powder and the rod 14 are ejected from the compacting chamber 2 at a suitable low speed. The capsule 11 (FIGS. 2 and 4), which contains the powder 6 and which may replace the hammer body 3 and act as hammer body is advantageously impacted against a stationary support means 7 such as in FIG. 4. The movable rod 14 is with its one free end inserted into the compaction chamber in order to minimize the effect of the relief waves and increase the duration of the pressure pulse to the maximum possible.

Referring to FIG. 2, a container 12 for hydraulic liquid 13 is fixed to the compaction chamber 2. The rod 14 is with its other end arranged in the liquid 13 and is held in position by the liquid 13 before the impact. The velocity imparted on the rod 14 by the impact is slowed down by the liquid 13 and the rod 14 is finally stopped. Introduction of the liquid 13 into the container 12 and ejection of liquid therefrom are controlled by a valve 15.

The duration of the compacting pressure following behind the shock wave and generated by the impact is controlled by the length and the impedance of the impact body and capsule, respectively, and the length and impedance of the support means. The rise time of the shock wave propagating through the powder is shorter than the time needed to obtain equalization of the overall temperature and the compacting pressure is maintained at least until the interparticle welds solidify. In this way the interweldable powder particles are dynamically compacted into a solid body by the propagating shock wave. The heat created during compaction works on the surfaces of the powder particles. The compacting pressure and its duration are controlled in such a way that permanent welds are created between the powder particles. No sintering of the created powder components is needed after the compaction. Because high temperature sintering is not needed it is possible by this technique to produce non-equilibrium alloys or powder mixtures. Also a component is obtainable which has a high density and which has a strength which approaches or even exceeds that of the annealed solid material.

Two results which are obtained from the calculation of the necessary conditions for dynamic compaction leading to interwelding of powder particles are striking. Firstly, the overall temperature rise is small in relation to the melting temperature of the material. This is due to the concentration of mechanical work and thus with the temperature rise at the surfaces of the particles. Secondly, the duration of the high temperature at the surfaces of the particles and the overall temperature rise are very short; the heating time as well as the heated time and the cooling time for the surfaces of the particles are on the order of microseconds and for the overall temperature rise on the order to milliseconds. Therefore, the states created by heat need not be considered. This means that alloys may be produced from mixtures which, if mixed with one another and exposed to temperatures above room temperature, would undergo thermally activated reactions.

As an example, carbon (graphite or diamonds) or carbides (tungsten etc.) could be mixed with steel. If produced in a conventional way the carbon or carbide would melt in a liquid metal, thereby creating a higher carbon steel. In another case, conventional powder metallurgy could be used, but again carbon in the steel during high temperature sintering (in fact in both cases this is a way in which carbon in the form of graphite is added to iron in order to obtain steel). However, in the case of diamonds and carbides this is not desirable because these are required as hard phases in the steel to give it hardness and wear resistance. By the above described dynamic powder compaction, in which sintering is superfluous, such materials can be produced. Certain combinations of carbides and diamonds in steel have already been produced experimentally. The prior choice of steel can, with the method of the present invention also allow conventional heat treatment, which is carried out at a much lower temperature than the sintering temperature and at which temperature no substantial diffusion of carbon into the steel occurs.

As a further example, steel powder could be added to aluminum powder in order to give wear resistance to the aluminum. The low weight and conductivity of aluminum are retained, while the steel particles act as points of high hardness and give the part a better wear resistance. The low wear resistance of aluminum and its tendency to "cold weld" are its main disadvantages. The Al-Fe alloy cannot be produced by the conventional method because a brittle intermetallic phase is created with aluminum and iron at temperatures above 500° C. Conventional sintering at a temperature of 600° C. would, therefore, result in a brittle weak part.

As a further example, copper particles could be added to aluminum in order to produce an aluminum alloy which can be soldered. In the conventional method, copper is dissolved in the aluminum in order to create a strong alloy which, however, cannot be soldered. In the above described method the copper particles are not dissolved in the aluminum so that solder connections can be made.

From the above described examples it is obvious that, depending on application and desired properties, different types of steel, aluminum and carbides could be used. Similarly, different sizes and forms of powder particles may be used in order to change the properties. Furthermore, there are several types of alloys or powder mixtures which would react with each other if produced using a conventional method.

With the above described technique, not only can mixtures of alloys which react with each other be produced, but also layered structures of such materials, which were mentioned above as examples, could be produced. These layered structures may only be thin surface coatings, like steel, which is applied to an aluminium part in order to increase its wear resistance, or it may be a true junction piece in which each part has the same length.

When producing special reactive alloys by compacting powder, fibers or wires may also be used in order to obtain a reinforced structure.

Finally, in the two last mentioned examples alloys consisting of two kinds of powder were described. However, it is also possible that more kinds of powder are compacted. An example of this is an alloy of aluminum, steel and graphite powder.

If desired, the final product may be heat treated in order to obtain the optimal mechanical properties by precipitated hardening.

The advantage of the above described method of compacting powder resides in the good quality of the welds produced between the powder particles, whereby parts having a strength comparable to that of the solid body are created. In the above mentioned method the costly and energy consuming process of sintering is eliminated. The melted material created between the powder particles acts as a lubricant, resulting in compacts with higher density than is predicted by the quasistatic pressure density relation. This, as well as the high pressure easily obtainable with the described method, result in a density of up to 100% of that of the solid body being reached. With the above described method, conditions can be obtained in a controlled way more easily, more cheaply, more reproducably and less dangerously than was possible with compaction by explosion. Furthermore, it is possible to produce other shapes than cylinders by this method, e.g. parts formed in a die.

We claim:

1. In a method of compacting powder comprising interweldable particles into a unitary structure by using a shock wave of such an amplitude as to create interparticle welding in the powder, said shock wave being generated by impacting an impact member against the powder which is supported by a support means in a compaction chamber, the improvement comprising:

controlling the compacting pressure so that it exceeds a lower limit value defined by the following equation $$s \cdot d\,(1-a) \cdot (bP)^2 \cdot (1+bP)^{\frac{1}{2}} > a^{5/2} b^{5/2} Ts\ Cp\ K\ \rho^{3/2}$$

where s is the shape factor depending on the shape of the powder particles, d is the size of the powder particles, a is the initial functional density of the powder, b is the compaction constant defined from the pressure density relation, P is the compaction pressure, Ts is the melting temperature of the resulting unitary structure Cp is the specific heat of the resulting unitary structure, K is the thermal conductivity of the resulting unitary structure, and $\rho$ is the density of the resulting unitary structure; and controlling the duration of the compaction pressure following behind the shock wave by selecting the length and impedance of said impact member and said support means, so that the shock wave is propagated through the powder with a shorter rise time than the time necessary for obtaining equalization of the overall temperature in the powder and so that the compacting pressure is maintained at least long enough for the welds on the powder particles to solidify;

the speed of the impact member relative to said powder being at least 300 m/sec at the instant of said impact.

2. The method of claim 1, comprising controlling the compacting pressure and its duration during formation of the welds on the powder particles so that the powder is compacted by the shock wave to a density which substantially corresponds to that of a solid body and that the welds are not pulled apart by subsequent pressure increases by relief waves reflected from the support means.

3. The method of claim 2, comprising determining the compacting pressure as a function of the velocity and impedance of said impact member.

4. The method of claim 1, wherein said speed of the impact member relative to said powder is between 300 and 2000 m/sec at the instant of said impact.

5. The method of claim 1, wherein said support means is a fixed support means (7).

6. The method of claim 1, wherein said support means includes a rod (14) which is movable in the impacting direction, said rod having such a length that the compacted powder and the rod are ejected from the compaction chamber (2) with a corresponding lower velocity than said impact velocity.

7. The method of claim 1, comprising generating a vacuum in the compaction chamber prior to said impacting.

8. The method of claim 1, comprising compacting one kind of powder into said unitary structure.

9. The method of claim 1, comprising compacting at least two kinds of powder into said unitary structure in order to obtain an alloy in which, at least at higher temperatures, the two kinds of powder are not in equilibrium with each other, the two kinds of powder forming the alloy being mixed before the shock wave is generated.

10. The method of claim 1, comprising compacting at least two kinds of powder into said unitary structure to obtain a layered structure, the two kinds of powder forming the layered structure being positioned in juxtaposition in said compaction chamber before the shock wave is generated by said impacting.

11. The method of claim 1, comprising adding reinforcing fibers to one kind of powder before generation of the shock wave to thereby form a reinforced unitary structure.

12. The method of claim 1, comprising mixing a metal and a non-metal powder and then compacting said mixture into said unitary structure.

13. In a method of compacting powder comprising interweldable particles into a unitary structure by using a shock wave of such an amplitude as to create interparticle welding in the powder, said shock wave being generated by impacting a capsule containing the powder against a support means, the improvement comprising:

controlling the compacting pressure so that it exceeds a lower limit value defined by the following equation $$s \cdot d\,(1-a) \cdot (bP)^2 \cdot (1+bP)^{\frac{1}{2}} > a^{5/2} b^{5/2} Ts\ Cp\ K\ \rho^{3/2}$$

where s is the shape factor depending on the shape of the powder particles, d is the size of the powder particles, a is the initial functional density of the powder, b is the compaction constant defined from the pressure density relation, P is the compaction pressure, Ts is the melting temperature of the resulting unitary structure Cp is the specific heat of the resulting unitary structure, K is the thermal conductivity of the resulting unitary structure, and $\rho$ is the density of the resulting unitary structure; and controlling the duration of the compaction pressure following behind the shock wave by selecting the length and impedance of said capsule and said support means, so that the shock wave is propagated through the powder with a shorter rise time than the time necessary for obtaining equalization of the overall temperature in the powder and so that the compacting pressure is maintained at least long enough for the welds on the powder particles to solidify;

the speed of the capsule containing said powder relative to said support means being at least 300 m/sec at the instant of said impact.

14. The method of claim 13, comprising controlling the compacting pressure and its duration during formation of the welds on the powder particles so that the powder is compacted by the shock wave to a density which substantially corresponds to that of a solid body and that the welds are not pulled apart by subsequent pressure increases by relief waves reflected from the support means.

15. The method of claim 14, comprising determining the compacting pressure as a function of the velocity and impedance of said capsule.

16. The method of claim 13, wherein said speed of said capsule relative to said support means is between 300 and 2000 m/sec at the instant of said impact.

17. The method of claim 13, wherein said support means is a fixed support means.

18. The method of claim 13, comprising generating a vacuum in the compaction chamber prior to said impacting.

19. The method of claim 13, comprising compacting, in said capsule, one kind of powder into said unitary structure.

20. The method of claim 13, comprising, in said capsule, at least two kinds of powder into said unitary structure to obtain an alloy in which, at least at higher temperatures, the two kinds of powder are not in equilibrium with each other, the two kinds of powder forming the alloy being mixed before the shock wave is generated.

21. The method of claim 13, comprising compacting at least two kinds of powder into said unitary structure to obtain a layered structure, the two kinds of powder forming the layered structure being positioned in juxtaposition in said capsule before the shock wave is generated by said impacting.

22. The method of claim 13, comprising adding reinforcing fibers to one kind of powder in said capsule before generation of the shock wave to thereby form a reinforced unitary structure.

23. The method of claim 13, comprising mixing a metal and a non-metal powder and then compacting said mixture, in said capsule, into said unitary structure.

* * * * *